US008019111B2

(12) United States Patent
Soheili

(10) Patent No.: US 8,019,111 B2
(45) Date of Patent: Sep. 13, 2011

(54) INTERCHANGEABLE HEADPHONE EARHOOK SUPPORT

(76) Inventor: Arian Soheili, Chula Vista, CA (US)

( * ) Notice: Subject to any disclaimer, the term of this patent is extended or adjusted under 35 U.S.C. 154(b) by 561 days.

(21) Appl. No.: 12/263,977

(22) Filed: Nov. 3, 2008

(65) Prior Publication Data

US 2010/0111347 A1 May 6, 2010

(51) Int. Cl.
*H04R 25/00* (2006.01)

(52) U.S. Cl. ..... 381/379

(58) Field of Classification Search ..... 381/370, 381/374, 379, 381
See application file for complete search history.

(56) References Cited

U.S. PATENT DOCUMENTS

| | | | | |
|---|---|---|---|---|
| 4,791,673 | A | 12/1988 | Schreiber | |
| 4,864,610 | A | 9/1989 | Stevens | |
| 4,893,344 | A | 1/1990 | Tragardh | |
| 4,917,504 | A | 4/1990 | Scott | |
| 4,972,468 | A | 11/1990 | Murase | |
| 5,210,792 | A | 5/1993 | Kajihara | |
| 5,412,736 | A | 5/1995 | Keliiliki | |
| 5,450,496 | A | 9/1995 | Burris | |
| 5,625,171 | A | 4/1997 | Marshall | |
| 5,655,026 | A * | 8/1997 | Peters et al. | 381/385 |
| 5,729,615 | A | 3/1998 | Yang | |
| 5,927,659 | A | 7/1999 | Yang | |
| 5,960,094 | A * | 9/1999 | Jensen et al. | 381/381 |
| 6,101,259 | A | 8/2000 | Rapps | |
| 6,104,824 | A | 8/2000 | Ito | |
| 6,377,697 | B1 | 4/2002 | Cheng | |
| 6,427,018 | B1 | 7/2002 | Keliiliki | |
| 6,772,853 | B2 | 8/2004 | Yang | |
| 6,914,997 | B2 | 7/2005 | MacDonald | |
| 6,981,569 | B2 | 1/2006 | Stilp | |
| 7,082,207 | B2 | 7/2006 | Rapps | |
| 7,106,877 | B1 | 9/2006 | Linville | |
| 7,221,771 | B1 | 5/2007 | DeKalb | |
| 7,231,056 | B2 | 6/2007 | Chen | |
| 7,346,180 | B2 | 3/2008 | Ham | |
| 7,599,508 | B1 * | 10/2009 | Lynch et al. | 381/330 |
| 2002/0041697 | A1 | 4/2002 | MacDonald | |
| 2003/0112991 | A1 | 6/2003 | Rapps | |
| 2004/0008855 | A1 | 1/2004 | Ham | |
| 2004/0091129 | A1 | 5/2004 | Jensen | |
| 2004/0131220 | A1 | 7/2004 | Liu | |
| 2004/0141628 | A1 * | 7/2004 | Villaverde et al. | 381/381 |
| 2005/0185814 | A1 | 8/2005 | Chen | |
| 2006/0171549 | A1 * | 8/2006 | Holmes | 381/330 |
| 2006/0177087 | A1 | 8/2006 | Ham | |
| 2006/0198544 | A1 | 9/2006 | Yueh | |
| 2008/0044051 | A1 | 2/2008 | Ikuma | |
| 2008/0075316 | A1 | 3/2008 | Chan | |
| 2008/0107301 | A1 | 5/2008 | Kim | |

* cited by examiner

*Primary Examiner* — Tuyen Nguyen
(74) *Attorney, Agent, or Firm* — Edwin Tarver; Lauson & Tarver LLP

(57) ABSTRACT

An improved headphone support assembly comprises a hook-shaped member for positioning over the ear of a user. The assembly comprises a clip or series of clips for releasably retaining a headphone wire, and disposes the wire at one terminal end of the hook-shaped member adjacent the auditory canal of a user. An 'earbud' type headphone wire is affixed to the member, with a predetermined amount of slack between the member and the headphone speaker to allow the speaker to move independently of the member. An adjustable arm attached to the lower portion of the hook-shaped member, and connected by a hinge, extends under the ear lobe of a user, and articulates to accommodate a variety of ear sizes.

12 Claims, 2 Drawing Sheets

INTERCHANGEABLE HEADPHONE EARHOOK SUPPORT

CROSS-REFERENCE TO RELATED APPLICATION

None

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

Portable personal listening devices are known in the art. One type of headphone for such devices is known as an 'earbud.' Earbuds are headphones of a smaller size placed directly outside the ear canal, but without fully enveloping it. Earbud headphones rely on an anchorage between the tragus and anti-tragus to hold them in place. However, this anchorage is tenuous and earbuds can be easily dislodged by tugging action exerted on the wires of the headphones.

In an attempt to compensate for this problem, a variety of devices have been developed to help anchor the headphones in place adjacent the auditory canal. These devices are generally hook-shaped members held fast between the ear and head of a user, and which hook over the top of the ear to dispose the headphone speaker in front of the ear. While these devices prevent the headphones from dislodging altogether, they are ineffective during strenuous exercise, since movement of the auricularis muscles cause the auricula of the ear to move, causing the speakers of the headphones to move relative to the auditory canal.

Another problem with 'earhook' type headphones is that the anchors are permanently affixed to the speakers. If a user wishes to switch to a different set of headphone speakers, a entirely new earhook must be purchased. U.S. Pat. No. 5,625,171 to Marshall discloses an interchangeable earpiece for stereo listening to address this problem. In Marshall, the speaker and wire is removable from the earpiece for interchanging different headphones and earpieces. However, the earpiece in Marshall attaches to the speaker in a manner that holds the speaker relative to the earpiece, resulting in the aforementioned problem of dislodging the speaker.

There is a need for an 'earhook' type device that interchangeably holds an 'earbud' type headphone, and which allows a user to engage in strenuous activity without dislodging the speaker of the headphone from the ear. There is also a need for an 'earhook' device that can accommodate a variety of sizes of ears.

Therefore it is an object of the present invention to provide an assembly that affixes to the ear of a user, disposed between the ear and the head, hooking over the top of the ear. A further object of the present invention is to provide an assembly that can interchangeably hold an 'earbud' type headphone. Another object of the present invention is to provide an assembly that can adjust to a variety of ear sizes. Yet another object of the present invention is to provide an assembly that can interchangeably hold an 'earbud' type headphone in a manner that allows the headphone to move relative to the assembly. These and other objects are further developed in the following summary, description and claims.

SUMMARY

The present invention comprises an improved headphone supporting assembly. The assembly further comprises a hook-shaped member designed to fit between the head and ear of a user. An adjustable member extends from the hook-shaped member to fit under a user's ear lobe. The adjustable member uses a hinge to articulate relative to the hook-shaped member to fit a variety of ear sizes.

Clips are disposed on the hook-shaped member, and comprise a channel with a narrow deformable slot through which a headphone wire may be pressed and retained. One clip holds the headphone wire at the terminal end of the hook-shaped member closest to the entrance to a user's ear. The hook-shaped member comprises an inner and outer layer, the inner being more rigid than the outer, which is made of a softer less rigid material for comfort and to assist in anchoring a headphone wire in the clips.

To use the headphone supporting assembly, a user places a headphone wire into the clips, allowing it to pass through the slot under pressure, and into the supporting channels. As the wire is inserted into the clip, a predetermined amount of slack is disposed between the terminal end of the assembly adjacent the auditory canal and the headphone speaker, enabling the assembly to move relative to the speaker during strenuous exercise without tugging on the speaker.

DESCRIPTION

Figure 1:
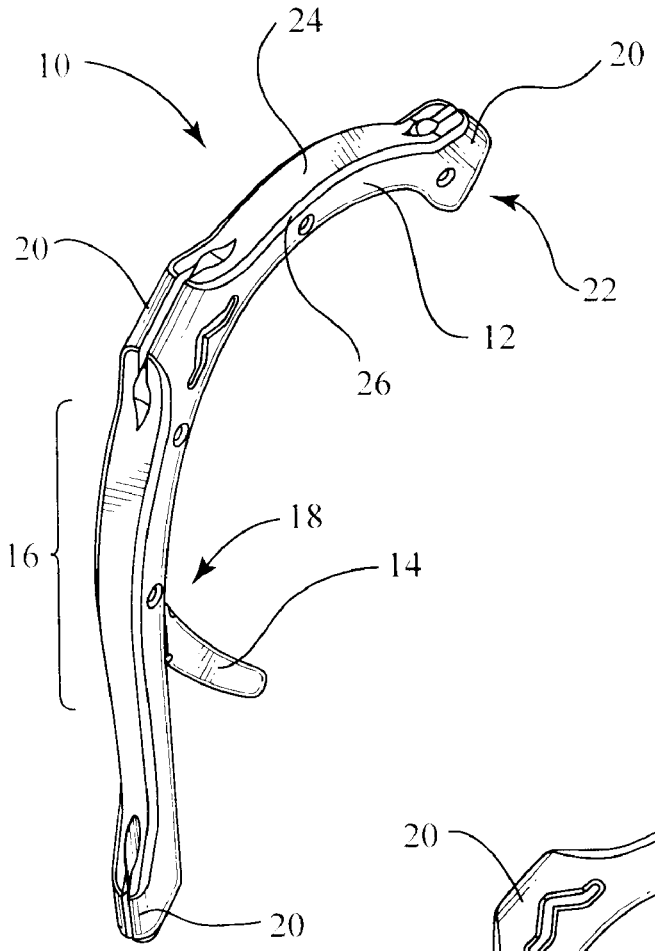
FIG. 1 is a perspective view of a headphone support assembly according to the new invention.
Figure 2:
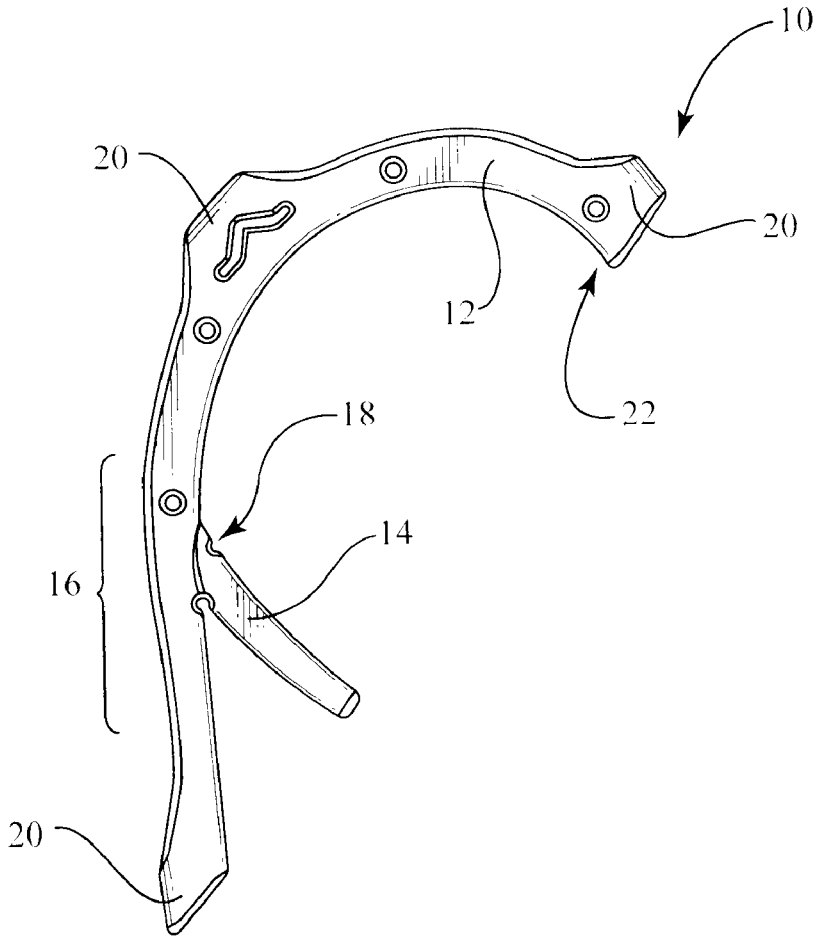
FIG. 2 is a side view of a headphone support assembly according to the new invention.

Referring to FIGS. 1-4, an improved headphone supporting assembly is shown and described. The assembly 10 comprises a substantially hook-shaped member 12, which can also be described as an arc with a more extreme curvature at one end and a less extreme curvature at the opposite end. The hook-shaped member 12 is designed to fit between the head and ear of a user, particularly behind the helix of the user's outer ear.

An adjustable member 14 adjoins the hook-shaped member 12 and extends from the lower portion 16 of the hook-shaped member 12 so as to fit under the lobule of a user's ear. The adjustable member 14 connects to the hook-shaped member 12 using a hinge means 18 for articulating the adjustable member 14 relative to the hook-shaped member 12. In one preferred embodiment, the hinge means 18 comprises a static connection further comprising a series of semi-circular cut-outs and fillet to ease stress on the hinge means 18 as the adjustable member 14 moves relative to the hook-shaped member 12.

The adjustable member 14 is biased to a predetermined position, and can be resiliently moved downwardly from the predetermined to another position under a user's ear, behind the earlobe. In this manner, the assembly 10 can fit a variety of ear sizes. In one preferred embodiment, the adjustable member 14 comprises an arc complimentary to the arc of the hook-shaped member 12 so that a continuous curvature is reflected in both members.

A clipping means 20 for holding a headphone wire is disposed on the hook-shaped member 12. The clipping means comprises a channel with a narrow slot through which a headphone wire may be pressed and retained. In various embodiments, the clipping means 20 may comprise a series of clipping means 20 that hold the headphone wire in a variety of positions. In one preferred embodiment, three clipping means 20 are disposed at either terminal end and along the length of the hook-shaped member 12; however in all embodiments, the headphone wire is held at the terminal end 22 of the hook-shaped member 12 closest to the entrance to a user's auditory canal.

Figure 3:
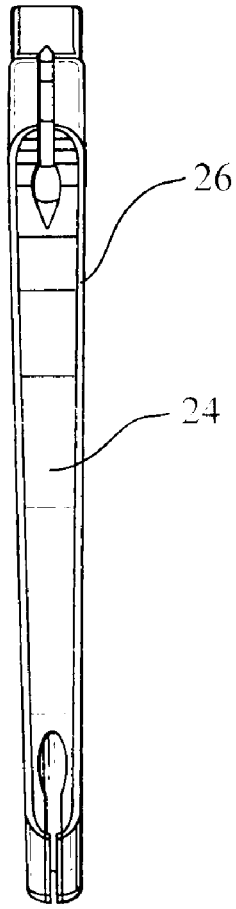
FIG. 3 is a rear view of a headphone support assembly according to the new invention.
Figure 4:
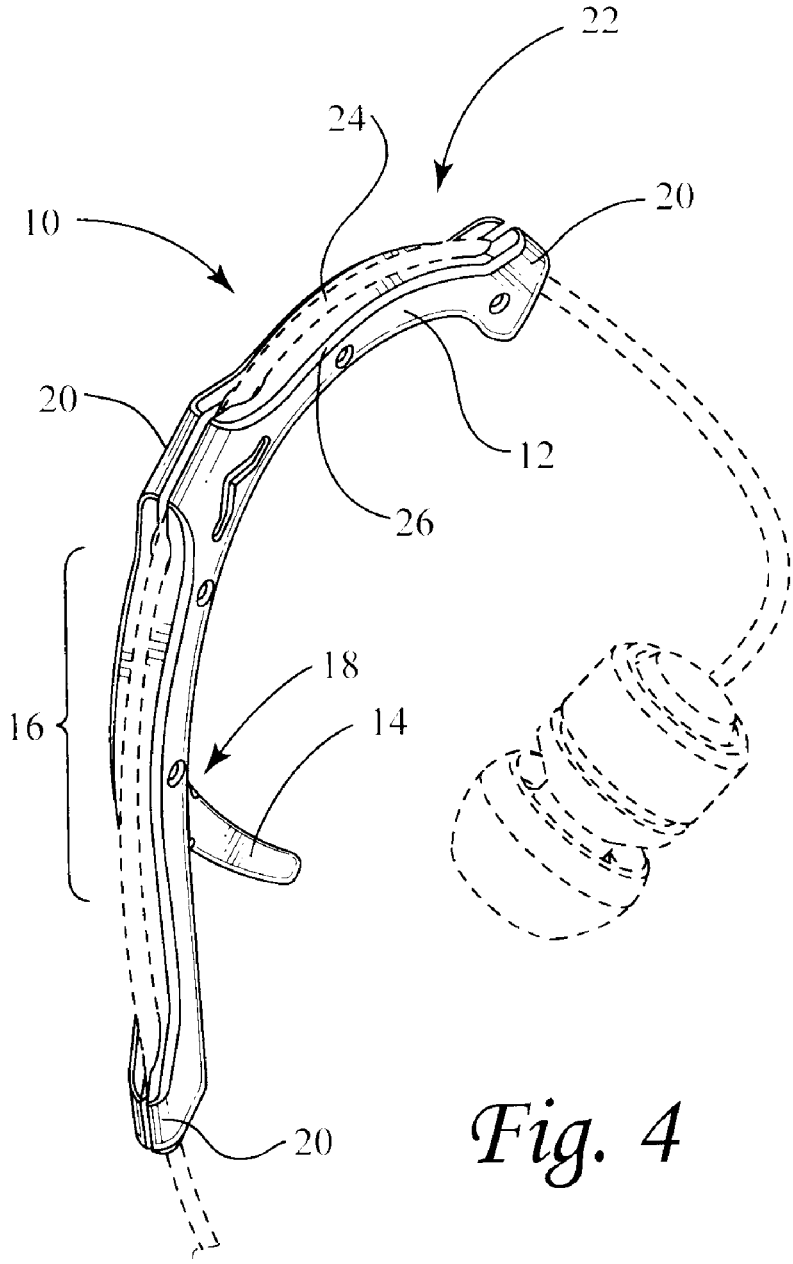
FIG. 4 is a perspective view of a headphone support assembly according to the new invention, supporting a headphone speaker and wire disposed therein.

Referring to FIGS. 1 and 3, in one preferred embodiment, the hook-shaped member 12 comprises an inner form 24 surrounded by an outer layer 26. The inner form 24 is more rigid than that outer form 26, which is made of a softer less rigid material for comfort and to assist in anchoring the headphone wire. In a preferred embodiment, the outer form 26 comprises is a thinner layer in diameter than the inner form 24.

Now turning to the method of using the headphone supporting assembly of the present invention, each assembly, comprising a hook-shaped member with clipping means and an adjustable arm, accommodates an individual headphone and wire. A user first places a headphone wire into the clipping means, or each of the clipping means along the ridge of the assembly. The slots of the clipping means are resiliently deformable so as to accommodate the wire of a headphone, allowing it to pass through the slot, under pressure, and into the wider wire supporting channel disposed below the slot.

As the wire is inserted into the clipping means, a user ensures that a predetermined amount of wire slack is left between the terminal end clipping means adjacent the auditory canal and the headphone speaker disposed in the user's ear, so that the assembly can move relative to the speaker during strenuous exercise without tugging on the speaker.

Once the wire has been inserted into the assembly, the assembly is placed over an ear so that the assembly is disposed between the ear and head, and the adjustable member is disposed under the ear behind the lobule. The adjustable arm is biased to a position that allows it to remain in place when accommodating smaller ears, and distends by action of the connecting hinge when accommodating larger ears.

After the assembly is in position, the headphone speaker can be inserted into an ear, and the speakers plugged into a personal electronic device, such as a personal stereo or radio. In this manner, a user can engage in strenuous activity, wherein the assembly is permitted to move relative to the headphone speaker, preventing the speaker from being pulled from the user's ear.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, paragraph 6. In particular, the use of "step of" in the claims herein is not intended to invoke the provisions of 35 U.S.C. §112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. An improved headphone supporting assembly comprising:

a. a substantially hook-shaped member, wherein the arc of the hook fits between the head and ear of a user, behind the helix of the user's outer ear;

b. an adjustable member adjoining the hook-shaped member, wherein the adjustable member extends from the lower portion of the hook-shaped member so as to fit under the lobule of the user's ear;

c. wherein the adjustable member connects to the hook-shaped member using a hinge means for articulating the adjustable member relative to the hook-shaped member, and wherein the adjustable member is resiliently downwardly movable from a first position to which it is biased, to a second position under the user's ear, behind the earlobe; and d. a clipping means for holding a headphone wire disposed on the hook-shaped member, wherein the clipping means holds the headphone wire at the terminal end of the hook-shaped member closest to the entrance to the user's auditory canal.

2. The assembly of claim 1, wherein the hook-shaped member comprises a generally arced member, and wherein the top of the member comprises a more pronounced arc, and the bottom of the member comprises a less pronounced arc.

3. The assembly of claim 1, wherein the hook-shaped member comprises two molded forms, one enclosed by the other.

4. The assembly of claim 3, wherein the enclosed molded form is rigid, while the enclosing molded form is resiliently deformable for ease and comfort of use.

5. The assembly of claim 1, wherein the adjustable member is connected to the hook-shaped member via a static connection, including a series of semi-circular cut-outs and fillet to ease stress on the connection.

6. The assembly of claim 5, wherein the adjustable member is curved in an arc corresponding to the arc of the hook-shaped member.

7. The assembly of claim 1, wherein the clipping means comprises multiple individual clipping means disposed on the hook-shaped member.

8. The assembly of claim 7, wherein three clipping means are disposed on the hook-shaped member.

9. The assembly of claim 8, wherein the clipping means are disposed at either terminal end of the hook-shaped member, and at a predetermined point between the terminal ends of the hook-shaped member, respectively.

10. An improved headphone supporting assembly comprising:

a. a substantially hook-shaped arced member, wherein the more extreme arc of the hook is disposed at the top of the hook-shaped member and fits between the head and ear of a user, behind the helix of the user's outer ear;

b. an adjustable member adjoined to the hook-shaped member, wherein the adjustable member extends from the lower portion of the hook-shaped member in the direction of the arc of the hook so as to fit under the lobule of a user's ear;

c. wherein the adjustable member connects to the hook-shaped member using a hinge means for articulating the adjustable member relative to the hook-shaped member, and wherein the adjustable member is downwardly deformable from a first position to which it is biased, to a second position under a user's ear, behind the earlobe; and d. a series of three clipping means for holding a headphone wire disposed on the hook-shaped member at either terminal end and at a predetermined position between the terminal ends, wherein each clipping means comprises a channel and deformable slot, through which a headphone cable may be pressed and retained.

11. A method of providing an ear-hook type support for holding the wires of ear-bud type headphones in a manner that allows the support to move independently of the headphones for use during strenuous activity, comprising the steps of:

a. providing a hook-shaped wire support comprising a hook-shaped member that hooks over the ear of a user, an adjustable member connected to the hook-shaped member and disposed under the ear in a manner that allows the adjustable member to resiliently deform to adjust to the size of a user's ear;

b. providing a series of clipping means for holding the wire of a headphone against the hook-shaped wire support, including at the first terminal end of the hook-shaped wire support adjacent the entrance to a user's auditory canal; and c. providing a predetermined length of wire slack between the first terminal end of the hook-shaped wire support and headphone, so that the hook-shaped wire support and headphone can move independently of each other within the bounds of the slack.

12. The assembly of claim 3, wherein the outer form is thinner in diameter than the inner form.

* * * * *